United States Patent [19]

Oyler

[11] Patent Number: 4,924,919

[45] Date of Patent: May 15, 1990

[54] METHOD OF FILLING A BALLOON WITH ARTICLES AND AIR

[75] Inventor: Lynn R. Oyler, Yorba Linda, Calif.

[73] Assignee: Balloon Wrap, Inc., Yorba Linda, Calif.

[21] Appl. No.: 266,709

[22] Filed: Nov. 3, 1988

[51] Int. Cl.[5] ..... B65B 1/04

[52] U.S. Cl. ..... 141/10; 141/65; 141/114; 141/8; 53/386; 53/390; 53/469; 53/468; 53/441; 446/220

[58] Field of Search ..... 141/8, 9, 10, 114, 7, 141/65; 206/522, 497; 53/386, 390, 443, 469, 468, 471, 441; 446/220, 221, 222, 223, 224, 225, 226

[56] References Cited

U.S. PATENT DOCUMENTS

| | | | |
|---|---|---|---|
| 1,288,095 | 10/1918 | Cummiskey | 446/220 |
| 1,471,886 | 4/1923 | Dessau | 446/220 |
| 2,201,486 | 9/1988 | Gold | 446/220 |
| 2,783,785 | 3/1957 | Carter | 141/51 |
| 2,972,612 | 1/1960 | Bulls et al. | 299/59 |
| 3,455,348 | 1/1967 | Stingele et al. | 141/65 |
| 3,722,557 | 3/1973 | Huggins | 141/59 |
| 4,060,107 | 11/1977 | Naftulin | 141/10 |
| 4,073,159 | 2/1978 | Trippi | 62/340 |
| 4,546,881 | 10/1985 | Tasma | 206/459 |
| 4,639,232 | 1/1987 | Wang | 446/220 |
| 4,691,700 | 9/1987 | Brychta et al. | 128/200.21 |
| 4,704,934 | 11/1987 | Nosrati | 446/220 |

*Primary Examiner*—Henry J. Recla
*Assistant Examiner*—Edward C. Donovan
*Attorney, Agent, or Firm*—Plante, Strauss, Vanderburgh & Connors

[57] ABSTRACT

A method of filling a balloon with articles and air wherein a container having a removeable cover having an outlet pipe therein the latter is evacuated after the opening of a balloon is attached to said pipe within the container to thereby expand the balloon and permit articles to be placed therewithin through the pipe. A stopper is then placed in the pipe and the air pump shut off whereby the end of the balloon can be tied off.

5 Claims, 1 Drawing Sheet

VACUUM SOURCE

METHOD OF FILLING A BALLOON WITH ARTICLES AND AIR

The present invention relates generally to apparatus and method for placing articles within a balloon and for filling the balloon with air for providing a unique package.

BACKGROUND OF THE INVENTION

For various occasions it is desirable to provide gifts for one's friends or relatives, and it is a further desire to provide something which is unique and out of the ordinary. In this regard, it is desirable to have a different or unique package for your gift to further emphasize the feelings between the giver and the receiver or at least to make the receiver feel extraordinary.

Heretofore, many different kinds of packages or packaging have been used to attempt to make such uniqueness and attractiveness, but most of such attempts have been very ordinary and usual. For instance, various different designs and colorings have been printed on wrapping paper to attempt to create such uniqueness, and yet, what with the myriad of presents or gifts that are exchanged, such attempts at making unusual designs on paper become somewhat ordinary.

In view of the foregoing, it is a desire to provide a unique package for articles which are given as gifts or presents such that the articles are within an inflated balloon. In this regard, it is believed that on the occurrence of an extremely unusual happening such as an engagement of marriage between people, an engagement ring or the like might be uniquely presented by being within a balloon filled with air.

However, it has been difficult to provide such unique packaging what with the size of the opening to a balloon as compared with articles which might be placed therewithin.

OBJECTS OF THE INVENTION

In view of the foregoing, it is an object of the present invention to provide apparatus and method of using same for the filling of a balloon with one or more articles as well as air under pressure.

Another object of the present invention is to provide apparatus and methodology as characterized above which includes the function of filling the balloon with air by means of evacuating a container wherein the balloon is operatively positioned.

Another object of the present invention is to provide apparatus and methodology as characterized above wherein a balloon is positioned within a container having a removeable cover formed with an inlet opening, the balloon being positioned about such opening and the interior of such container evacuated to cause air to flow into the balloon and to provide an opening through which articles can be placed therewithin.

A still further object of the present invention is to provide apparatus and methodology as characterized above wherein the flexible inlet to a balloon is mounted on the cover of the container so that the balloon can be expanded so that articles as well as air can be caused to enter the balloon.

A still further object of the present invention is to provide apparatus and methodology as characterized above which is simple and inexpensive to manufacture and which is rugged and dependable in operation.

BRIEF DESCRIPTION OF THE DRAWINGS

The novel features which I consider characteristic of my invention are set forth with particularity in the appended claims. The invention itself, however, both as to its organization and mode of operation, together with additional objects and advantages thereof, will best be understood from the following description of specific embodiments when read in combination with the accompanying drawings, in which:

Like reference characters indicate corresponding parts throughout the several views of the drawings.

DESCRIPTION OF THE PREFERRED EMBODIMENT

Figures 1, 2, 3, 4, 5, 6, 7, 8:
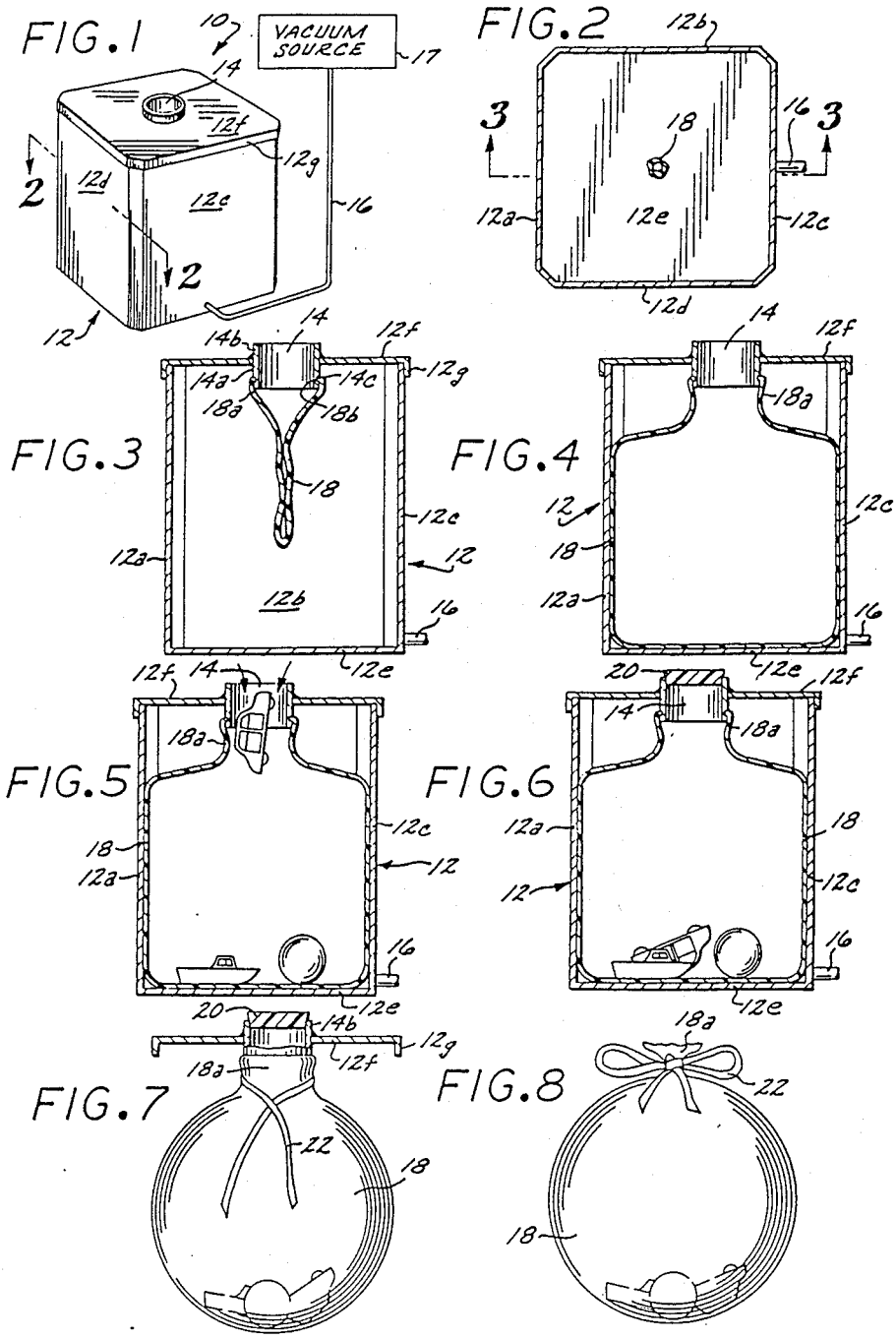
FIG. 1 is a perspective view of apparatus according to the present invention.
FIG. 2 is a horizontal sectional view taken substantially along line 2—2 of FIG. 1.
FIG. 3 is a sectional view taken substantially along line 3—3 of FIG. 2 of the drawings.
FIG. 4 is a sectional view similar to FIG. 3, showing the inflated balloon.
FIG. 5 is a similar sectional view showing the insertion of articles.
FIG. 6 is a similar sectional view showing the use of a stopper in the container opening.
FIG. 7 is a fragmentary sectional view showing the cover removed from the body of the container.
FIG. 8 shows the finished balloon package.

Referring to FIG. 1 of the drawings, there is shown therein apparatus 10 for use in filling an expandable balloon with air and various articles. Such apparatus includes a container 12 having sidewalls **12*a*, 12*b*, 12*c* and 12*d*, as well as bottomwall 12*e*. Also part of the container 12 is a removeable cover 12*f* having an offset edge 12*g*** thereabout for closure cooperation with the sidewalls of the container, as shown in the drawings.

Although the container shown in the drawings has corner sections at 45 degrees to the sidewalls that are being joined, it will be readily understood by those persons skilled in the art, that such construction is not necessary for successful practice of the present invention, but rather the sidewalls of the container 10 may meet at 90 degrees to each other. In fact, the specific construction of the container 12 is not critical to successful practice of the present invention, it being well understood by those persons skilled in the art that the shape or design of such container can vary as desired.

Positioned within the cover **12*f* is an intake pipe 14 which is hermetically sealed within a through opening in cover 12*f*, as by means of bonding, welding, soldering, brazing or the like. Such opening within cover 12*f* is preferably centrally located within the cover. Pipe 14 is so positioned within the cover 12*f* as to have an interior portion 14*a* within container 12, and an exterior portion 14*b*. As will hereinafter be explained in greater detail, the interior portion 14*a* of pipe 14 is formed with an annular groove or recess 14*c***.

Mounted within an opening formed in the sidewall **12*c* of container 12 is a conduit 16 which leads to a vacuum source or air pump 18**. Such vacuum source, of course, includes external power such as electricity or the like (not shown) for operation of the air pump.

As shown most particularly in FIG. 3, to fill a balloon with articles and air, a balloon 18 having a flexible opening **18*a* is positioned within container 12, with such opening 18*a* positioned about the interior portion 14*a* of pipe 14. In this regard, most balloons are formed with a flexible bead 18b about the end 18a, and it has been found desirable to locate such bead within the annular groove 14c of pipe 14**. This arrangement assists in retaining the balloon in the proper position during filling as will hereinafter become more apparent.

With the balloon so positioned, the air pump which is part of vacuum source 18, is caused to operate to thereby decrease the pressure within container 12, as shown in FIG. 4. This causes the atmospheric pressure about container 12 to force air into the balloon through pipe 14, thus causing the balloon to expand by being filled with air as shown in FIG. 4 of the drawings.

With the balloon so inflated, articles, as shown in FIG. 5 of the drawings, can be placed into the balloon through the pipe 14. Thereafter, as shown in FIG. 6 of the drawings, a stopper or plug 20 is placed in the exterior portion 14b of pipe 14 so as to interrupt the flow of air into or out of the balloon 18.

The air pump is then turned off, enabling the cover 12f to be removed from the sidewalls of the container 12 so as to appear as shown in FIG. 7 of the drawings. Thereafter, the balloon 18 can have the flexible open end 18a thereof tied off with string, ribbon 22 or the like so as to provide a unqiue package for the articles, as shown most particularly in FIG. 8 of the drawings. As will be well realized, the stopper 20 can then be removed from pipe 14 and the entire process or methodology repeated to fill other balloons with articles and air as above explained.

It is thus seen that the present invention provides unique apparatus and method for filling a balloon with articles as well as air to provide a unique and distinctive package for such articles.

Although I have shown and described certain specific embodiments of my invention, I am well aware that many modifications thereof are possible. The invention, therefore, is not to be restricted except insofar as is necessitated by the prior art and by the spirit of the appended claims.

I claim:

1. The method of filling an elastic balloon having its natural inflated balloon shape with an inflated volume and an opening of lesser diameter than the diameter of said inflated balloon to provide a package having said natural inflated balloon shape that contains irregularly shaped articles and air, comprising the steps of:

providing a container defining an airtight chamber with an internal volume greater than said inflated volume of said balloon, with a first opening and a second opening therein, said second opening receiving a tubular member having a passageway of dimensions sufficiently large to permit passage of said irregularly shaped articles but less than the dimensions of said chamber, securing said opening of said elastic balloon to said tubular member, stretched sufficiently to expand said opening to said dimensions of said tubular member to thereby provide a through passageway into said balloon with dimensions sufficiently large to permit passage of said articles, and placing said balloon within said airtight chamber of said container, causing an air pump to be operatively positioned at said first opening and to be operated to evacuate air from said chamber while permitting unrestricted flow of air at ambient pressure to enter said balloon through said tubular member and thereby inflate and expand said balloon into said natural inflated balloon shape, filling said balloon with articles through said tubular member, recovering said package from said container by the steps of: closing off said through passageway while said balloon is filled with air and restoring the pressure within said chamber to atmospheric pressure, and removing said balloon from said chamber.

2. The method of filling a balloon according to claim 1 wherein said through passageway is closed by placing a stopper in said tubular member after said balloon is filled with articles and air prior to said steps of restoring said pressure and removing said balloon, to allow the opening of said balloon to be tied off without losing air.

3. The method of filling a balloon according to claim 2 wherein said container has a removable wall wherein said second opening is provided, and said wall is removed following placement of said stopper in said tubular member to enable said balloon to be tied off.

4. The method of filling a balloon according to claim 2 wherein the operation of said air pump is caused to cease following placement of said stopper in said tubular member and before the container wall is removed.

5. The method of filling a balloon according to claim 2 wherein said tubular member is a pipe of predetermined length, the opening of said balloon being secured to said pipe within said container, articles being placed in said balloon through said pipe, and said stopper is placed in said pipe exteriorly of said container.

* * * * *